United States Patent [19]

Grosskopf

[11] Patent Number: 4,734,895

[45] Date of Patent: Mar. 29, 1988

[54] NOVELTY WATCH CONSTRUCTION

[75] Inventor: Mark Grosskopf, Palm Beach, Fla.

[73] Assignee: Jewelmasters, Inc., West Palm Beach, Fla.

[21] Appl. No.: 75,403

[22] Filed: Jul. 20, 1987

[51] Int. Cl.[4] ..... G04B 19/06; G04B 25/06

[52] U.S. Cl. ..... 368/229; 368/223

[58] Field of Search ..... 368/229, 228, 230–238, 368/223–227, 179, 165

[56] References Cited

U.S. PATENT DOCUMENTS 3,183,659 5/1965 Etienne ..... 368/229

FOREIGN PATENT DOCUMENTS 609517 3/1979 Switzerland ..... 368/229

*Primary Examiner*—Bernard Roskoski

*Attorney, Agent, or Firm*—Charles E. Temko

[57] ABSTRACT

A novelty watch construction is disclosed. The face of the watch or dial includes first and second members, the first one being substantially smaller in diameter than that of the watch crystal. It overlies the second dial in spaced parallel relation, to form an interstice therebetween. The second dial member has a diameter approximating that of the crystal. A pendulum-like support is mounted on bearings between the first and second dials for orbital movement relative to the dial members and hands, the support carrying an exposed jewel or jewels which move within the circular area between the periphery of the first and second dial members. Where the jewel is provided with facets, such movement causes a continuously changing sparkle effect.

3 Claims, 2 Drawing Figures

NOVELTY WATCH CONSTRUCTION

BACKGROUND OF THE INVENTION

This invention relates generally to the field of novelty jewelry, and more particularly to an improved novelty watch in which provision has been made for the incorporation of a rotatably movable jewel support, the movement of which is actuated by movement of the watch case while wearing the same.

It is known in the art to manufacture watches incorporating pendulum means for winding the main spring of the movement accompanying movement of the wrist or arm of the wearer. Such pendulums incorporate an overrunning clutch which permits the transfer of rotational movement to one end of the main spring. The pendulum is relatively heavy, and is located within the watch case beneath the movement. The face or dial of the watch and the minute and hour hands underlie the total area of the crystal.

SUMMARY OF THE INVENTION

Briefly stated, the invention contemplates the provision of an improved novelty watch in which a pendulum-like member is positioned in the watch case above the movement so as to be visible through the watch crystal. Pivoting movement occurs about an axis concentric with the axis of rotation of the minute and hour hands. The face of the watch includes first and second dials, a first dial of which is substantially smaller in diameter than the diameter of the crystal, and a second dial of which is maintained in spaced parallel relation with respect to the first dial and is of diameter substantially equivalent to that of the crystal. The first and second dials thus form a circular interstice in which a pendulum-like support carrying a jewel at its free end rotates under the action of gravity. The jewel is thus exposed beneath the crystal and travels in an arcuate path at the outer periphery of the first dial.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
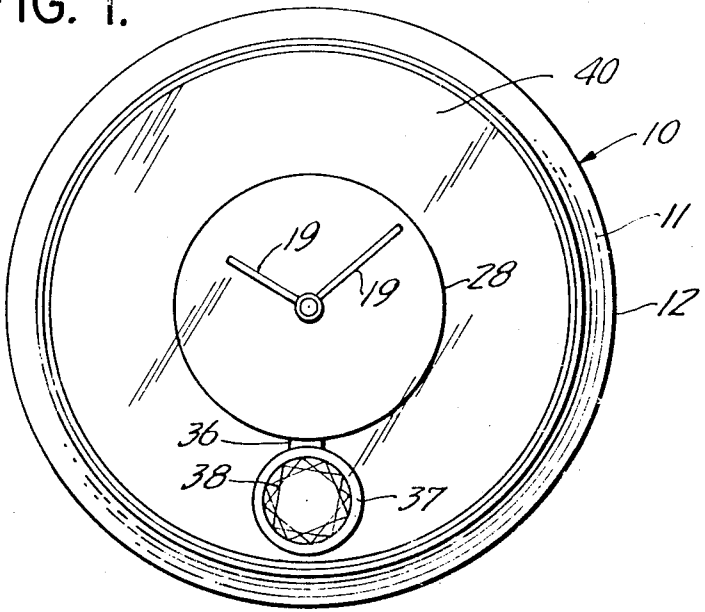
FIG. 1 is a top plan view of a watch case embodying the invention.
Figure 2:
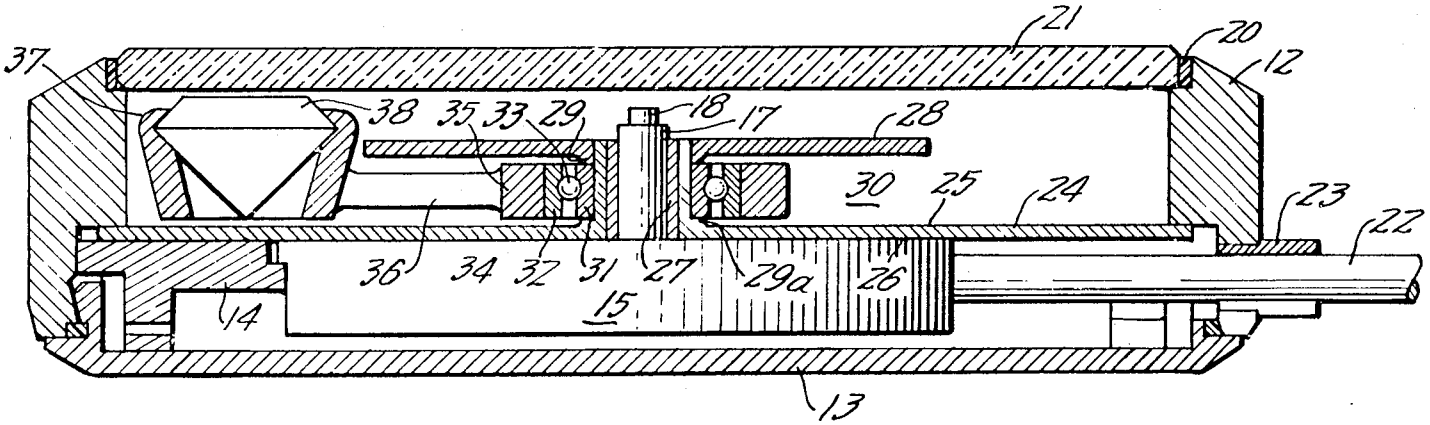
FIG. 2 is a transverse central sectional view thereof.

In accordance with the invention, the device, generally indicated by reference character 10 comprises broadly: a watch case element 11 including a bezel 12, a rear back 13, a planar movement holder 14, a conventional movement 15, a minute hand support 17, an hour hand support 18, and relatively movable hands 19.

The bezel 12 may be formed of any suitable material, and includes a circular recess 20 mounting a planar transparent crystal 21. A winding stem 22 is conventional and is mounted in a support 23.

Overlying the movement 15 is a bottom dial member 24 having inner and outer surfaces 25 and 26, respectively. The member 24 supports a centrally disposed hollow stem 27 which positions a top dial member 28 of diameter substantially smaller than that of the bottom dial member 24. The top dial member 28 includes a central enlargement 29 which cooperates with a recess 29A in the stem 27 to form an interstice 30 and maintain in position a ball bearing inner race 31. A corresponding outer race 32 is free turning, and encloses ball bearings 33 in a known manner.

Supported by the outer race 32 by a force fit or other suitable interconnection is a pendulum member 34 including an inner ring 35, a radially extending member 36 and a jewel support member 37 at a free end of the member 36. The member 37 supports one or more jewels 38, shown in the drawing as a brilliant cut diamond. The pendulum 34 moves in a circular path 40 surrounding the top dial member 28, and is thus clearly visible at all times through the crystal 21.

When the device 10 is worn, the pendulum 34 will rotate in either of two directions as the watch case is shifted with movement of the wrist of the wearer, under the action of gravity. As viewed through the crystal 21, only the support 37 will be visible to a user, the remaining parts of the pendulum 34 being concealed beneath the top dial member 28.

I wish it to be understood that I do not consider the invention limited to the precise details of structure shown and set forth in this specification, for obvious modifications will occur to those skilled in the art to which the invention pertains.

I claim:

1. A novelty watch construction comprising: a generally circular watch case, including a bezel, a crystal and a back cover overlying opposite sides of said bezel; a watch movement disposed adjacent said cover, a first dial member overlying said movement having a diameter substantially equal to the diameter of said crystal, a second dial member overlying said first dial member in spaced parallel relation and having a diameter substantially less than that of said first dial member; means supporting said second dial member in said spaced parallel relation relative to said first dial member to define a circular interstice therebetween; bearing means supported by said last-mentioned means and having an axis of rotation perpendicular first and second dial members; a pendulum supported for rotation by said bearing means and having a radially oriented support extending past the periphery of said second dial member, and a decorative member supported by said pendulum on a free end thereof, said decorative member moving in an arcuate path beneath said crystal and radially outwardly of said second dial member.

2. A watch construction in accordance with claim 1, further characterized in said bearing means including plural ball bearings.

3. A watch construction in accordance with claim 1, further characterized in said decorative member including a faceted jewel.

* * * * *